US008393418B2

(12) United States Patent
Gallifet et al.

(10) Patent No.: US 8,393,418 B2
(45) Date of Patent: Mar. 12, 2013

(54) ROCK BIT HAVING A SEAL GLAND WITH A CONICAL SEALING SURFACE

(75) Inventors: Thomas Gallifet, Garland, TX (US); David Michel Harrington, Dallas, TX (US)

(73) Assignee: Varel International, Ind., L.P., Carrollton, TX (US)

( * ) Notice: Subject to any disclaimer, the term of this patent is extended or adjusted under 35 U.S.C. 154(b) by 280 days.

(21) Appl. No.: 12/757,959

(22) Filed: Apr. 9, 2010

(65) Prior Publication Data

US 2010/0194057 A1 Aug. 5, 2010

Related U.S. Application Data

(62) Division of application No. 12/147,238, filed on Jun. 26, 2008, now Pat. No. 7,721,827.

(60) Provisional application No. 60/956,426, filed on Aug. 17, 2007.

(51) Int. Cl.
*E21B 10/25* (2006.01)

(52) U.S. Cl. ..... 175/372; 175/331; 175/371

(58) Field of Classification Search ..... 175/331, 175/371, 372

See application file for complete search history.

(56) References Cited

U.S. PATENT DOCUMENTS

| | | | | |
|---|---|---|---|---|
| 3,397,928 | A | 8/1968 | Galle | |
| 3,765,495 | A | 10/1973 | Murdoch et al. | |
| 4,073,548 | A * | 2/1978 | Walters | 384/93 |
| 4,151,999 | A | 5/1979 | Ringel et al. | |
| 4,199,156 | A | 4/1980 | Oldham et al. | |
| 4,372,624 | A | 2/1983 | Neilson | |
| 4,554,985 | A * | 11/1985 | Backlund | 175/371 |
| 4,776,599 | A | 10/1988 | Vezirian | |
| 5,129,471 | A | 7/1992 | Maurstad et al. | |
| 5,524,718 | A * | 6/1996 | Kirk et al. | 175/371 |
| 5,655,611 | A | 8/1997 | Dolezal et al. | |
| 6,752,223 | B2 * | 6/2004 | Panigrahi et al. | 175/57 |
| 2008/0099244 | A1 | 5/2008 | Chellappa et al. | |

* cited by examiner

*Primary Examiner* — Jennifer H Gay
*Assistant Examiner* — Elizabeth Gitlin
(74) *Attorney, Agent, or Firm* — Gardere Wynne Sewell LLP; Andre M. Szuwalski

(57) ABSTRACT

A drill bit includes a bit head and a rotating bit cone. A sealing system for the drill bit includes a seal gland and a seal retained within the seal gland. The seal gland is defined by a radial cone surface, a head sealing surface and an opposed cone sealing surface. At least one of the head sealing surface and opposed cone sealing surface is not cylindrical (i.e., the surface is conical and not parallel to an axis of rotation for the cone). Additionally, the radial cone surface may be conical (i.e., the surface does not extend perpendicular to the axis of rotation of the cone). The seal is radially compressed between the head sealing surface and the opposed cone sealing surface. The use of one or more conical surfaces in the gland is provided to bias the compressed seal into a preferred dynamic sealing zone.

21 Claims, 7 Drawing Sheets

ROCK BIT HAVING A SEAL GLAND WITH A CONICAL SEALING SURFACE

PRIORITY CLAIM

The present application is a divisional of U.S. application patent Ser. No. 12/147,238 filed Jun. 26, 2008, which claims the benefit of U.S. Provisional Application for Patent 60/956,426 filed Aug. 17, 2007 entitled "Rock Bit With Asymmetric Sealing Pressure Distribution", the disclosures of which are hereby incorporated by reference to the maximum extent allowable by law.

BACKGROUND OF THE INVENTION

1. Technical Field of the Invention

The present invention relates to earth boring bits, and more particularly to those having rotatable cutters, also known as cones.

2. Description of Related Art

Reference is made to U.S. Pat. No. 5,129,471 to Maurstad the disclosure of which is hereby incorporated by reference. Reference is also made to U.S. Pat. No. 3,397,928 to Galle the disclosure of which is hereby incorporated by reference. Reference is still further made to U.S. Pat. No. 4,372,624 to Neilson the disclosure of which is hereby incorporated by reference. Reference is also made to U.S. Pat. No. 3,765,495 to Murdoch the disclosure of which is hereby incorporated by reference.

Earth boring bits with rolling element cutters have bearings employing either rollers as the load carrying element or with a journal as the load carrying element. The use of a sealing means in rock bit bearings has dramatically increased bearing life in the past fifty years.

Early seals for rock bits were designed with a metallic Belleville spring clad with an elastomer, usually nitrile rubber (NBR). The metallic spring provided the energizing force for the sealing surface, and the rubber coating sealed against the metal surface of the head and cone and provided a seal on relatively rough surfaces because the compliant behavior of the rubber coating filled in the microscopic asperities on the sealing surface. Belleville seals of this type were employed mainly in rock bits with roller bearings. The seal would fail due to wear of the elastomer after a relatively short number of hours in operation, resulting in loss of the lubricant contained within the bearing cavity. The bit would continue to function for some period of time utilizing the roller bearings without benefit of the lubricant.

A significant advancement in rock bit seals came when o-ring type seals were introduced. These seals, as disclosed by Galle, were composed of nitrile rubber and were circular in cross section. The seal was fitted into a radial gland formed by cylindrical surfaces between the head and cone bearings, and the annulus formed was smaller than the original dimension as measured as the cross section of the seal. The squeeze of the seal was defined as the percentage reduction of the cross section from its original state to the deflected state. Murdoch disclosed a variation of this seal by elongating the radial dimension which, when compared to the seal disclosed by Galle, required less percentage squeeze to form an effective seal. Several other minor variations of this concept have been used, each relying on an elastomer seal squeezed radially in a gland formed by cylindrical surfaces between the two bearing elements. Nielson describes what is called a V-ramp seal gland. In this arrangement, the seal is compressed between two concentric surfaces with at least one of the surfaces having a V-shaped cross section. The seal is centrally located in the V-ramp aligned with an axis of symmetry for the surfaces forming the V-shaped cross section.

To minimize sliding friction and the resultant heat generation and abrasive wear, rotating O-rings are typically provided with a minimal amount of radial compression. However, reciprocating seals must have a much larger radial compression to exclude contamination from the sealing zone during axial sliding (typically about twice the compression). The rock bit seal must both exclude contamination during relative head/cone axial motion and minimize abrasive wear during rotation.

A need exists in the art for an improved sealing system for use in rock bits.

SUMMARY OF THE INVENTION

Experience has shown that seal life is related to the compression between sealing surfaces. As compression increases, seal life decreases. During bearing operation, the bearing shaft and cone will move axially with respect to each other due to bearing clearances. Additionally, typical rock bit bearings operate with an internal pressure greater than the environment. Control should be exercised over seal axial motion in order to retain the seal in the preferred dynamic sealing zone during operation. If control is not exercise, this may lead to erratic and unpredictable seal wear rate (life, performance) in operation. A need exists to retain the seal in a preferred dynamic sealing zone between two surfaces located in the cone.

The geometry of a seal gland utilizes one or more conical sealing surfaces to assist in retaining the seal in the preferred dynamic sealing zone. Opposed sealing surfaces which squeeze the seal between the cone and shaft form an angle with respect to each other such that at least one of the surfaces is not cylindrical.

In an embodiment, a sealing system for a drill bit including a bit head and a rotating bit cone comprises: a seal gland defined by a radial cone surface and further defined by a cylindrical head sealing surface and an opposed conical cone sealing surface; a seal radially compressed between the cylindrical head sealing surface and the opposed conical cone sealing surface; wherein the conical cone sealing surface extends radially inwardly from the radial cone surface and an angle defined between the conical cone sealing surface and the opposed cylindrical head sealing surface is between about 2 and 40 degrees.

In another embodiment, a sealing system for a drill bit including a bit head and a rotating bit cone comprises: a seal gland defined by a radial head surface and further defined by a cylindrical cone sealing surface and an opposed conical head sealing surface; a seal radially compressed between the cylindrical cone sealing surface and the opposed conical head sealing surface; wherein the conical head sealing surface extends radially outwardly from the radial head surface and an angle defined between the conical head sealing surface and the opposed cylindrical cone sealing surface is between about 2 and 40 degrees.

In another embodiment, a sealing system for a drill bit including a bit head and a rotating bit cone comprises: a seal gland defined by a radial cone surface and further defined by a conical head sealing surface and an opposed conical cone sealing surface; and a seal radially compressed between the conical head sealing surface and the opposed conical cone sealing surface.

In another embodiment, a sealing system for a drill bit including a bit head and a rotating bit cone comprises: a seal gland defined by a radial cone surface and further defined by a cylindrical head sealing surface and an opposed conical cone sealing surface; a seal radially compressed between the cylindrical head sealing surface and the opposed conical cone sealing surface; wherein the conical cone sealing surface extends radially inwardly from the radial cone surface and wherein the radial cone surface and conical cone sealing surfaces are not symmetric about an axis extending perpendicular to the cylindrical head sealing surface.

In an embodiment, a sealing system for a drill bit including a bit head and a rotating bit cone comprises: a seal gland defined by a radial cone surface and further defined by a head sealing surface and an opposed cone sealing surface; a seal radially compressed between the head sealing surface and the opposed cone sealing surface; wherein an angle defined between the cone sealing surface and the opposed head sealing surface is about between 2 and 40 degrees.

In an embodiment, a sealing system for a drill bit including a bit head and a rotating bit cone comprises: a seal gland defined by a radial cone surface and further defined by a head sealing surface and a conical cone sealing surface opposed to the head sealing surface, the radial cone surface having a first end adjacent the head sealing surface and further having a second end, the conical cone sealing surface connected to and extending radially inwardly from the second end of the radial cone surface; and a seal compressed between the head sealing surface and the opposed conical cone sealing surface.

In an embodiment, a sealing system for a drill bit including a bit head and a rotating bit cone comprises: a seal gland defined by a radial cone surface and further defined by a head sealing surface and a conical cone sealing surface opposed to the head sealing surface, the radial cone surface having a first end and a second end, the conical cone sealing surface extending radially inwardly of the second end of the radial cone surface; and a seal compressed between the head sealing surface and the opposed cone sealing surface.

In an embodiment, a sealing system for a drill bit including a bit head and a rotating bit cone comprises: a seal gland defined by a radial cone surface and further defined by a head sealing surface and a conical cone sealing surface opposed to the head sealing surface, the radial cone surface having a first end and a second end, the conical cone sealing surface extending radially inwardly and being positioned closer to an axis of cone rotation than the second end of the radial cone surface; and a seal compressed between the head sealing surface and the opposed cone sealing surface.

BRIEF DESCRIPTION OF THE DRAWINGS

Other features and advantages of the invention will become clear in the description which follows of several non-limiting examples, with references to the attached drawings wherein.

DETAILED DESCRIPTION OF THE DRAWINGS

Figure 1:
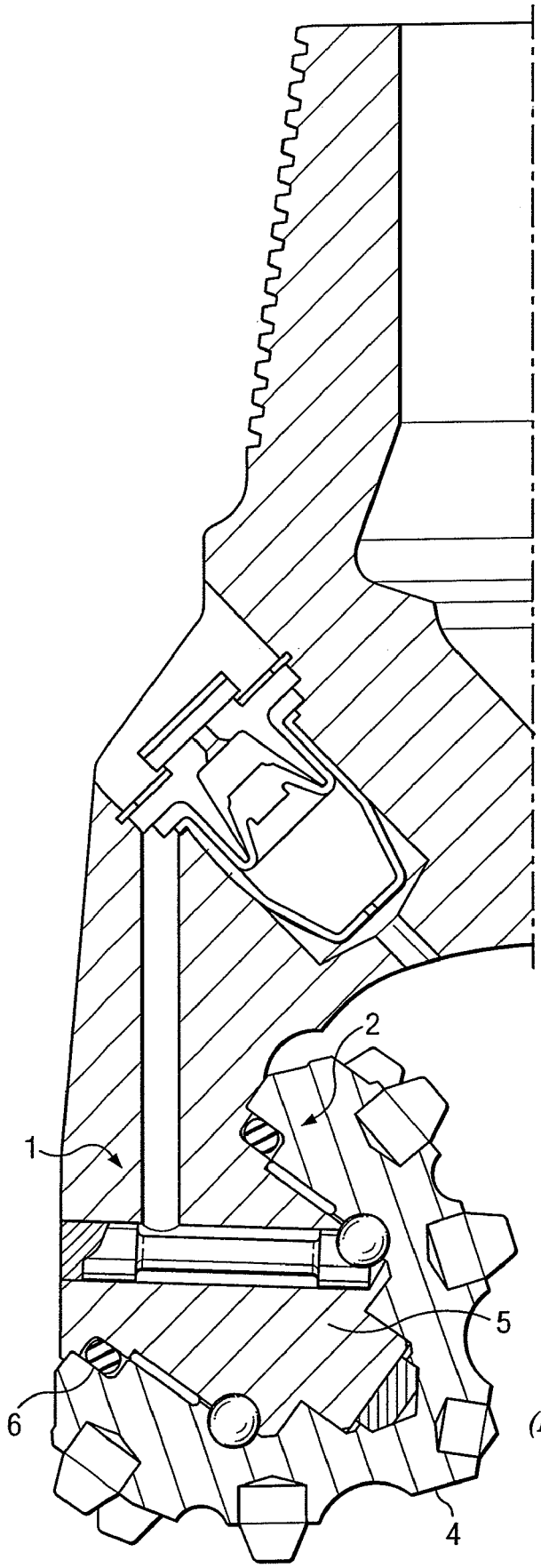
FIG. 1 (PRIOR ART)
FIG. 1 illustrates a prior art configuration for an earth boring bit.
Figure 2:
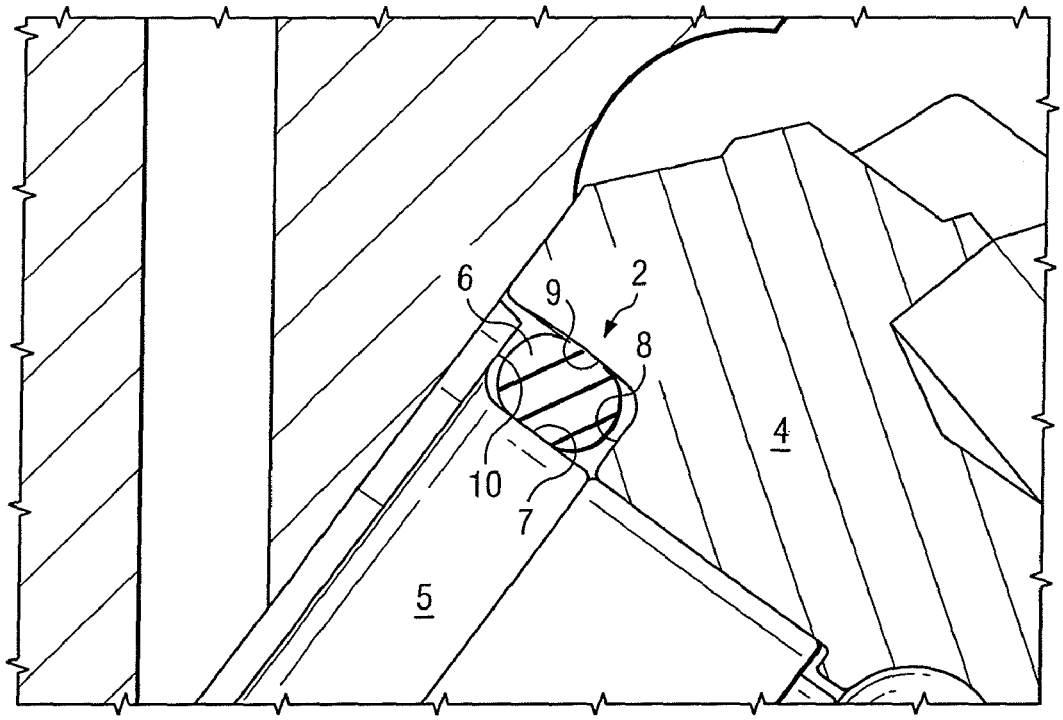
FIG. 2 (PRIOR ART)
FIG. 2 illustrates a close-up view of the prior art configuration of FIG. 1 focusing on the area of the seal.

Reference is now made to FIG. 1 which illustrates a prior art configuration for an earth boring bit. FIG. 2 illustrates a close-up view of the prior art configuration focusing on the area of the sealing system 2 associated with a rotating cone 4 and a shaft 5 of the bit head 1. An o-ring seal 6 is squeezed between a cylindrical cone sealing surface 9 and a cylindrical head sealing surface 7. The term "cylindrical" in this context refers to a surface that is parallel to an axis of cone rotation. An inner radial cone surface 8 is provided on the grease side of the seal, while an outer radial head surface 10 is provided on the drilling fluid side of the seal. The term "radial" in this context refers to a surface extending away from the axis of cone rotation. In this illustrated implementation, the radial surfaces 8 and 10 are normal (i.e., perpendicular) to the axis of cone rotation. It will be noted that the sealing pressure is between surfaces 7 and 9. A concern with respect to this implementation occurs in response to positive internal bearing pressure within the cone 4 and seal. When this occurs, the o-ring seal 6 is pushed against the outer radial head surface 10 and the radius formed between cylindrical head surface 7 and outer radial head surface 10. This causes wear of the seal 6 and leads to sealing system 2 failure.

Figure 3:
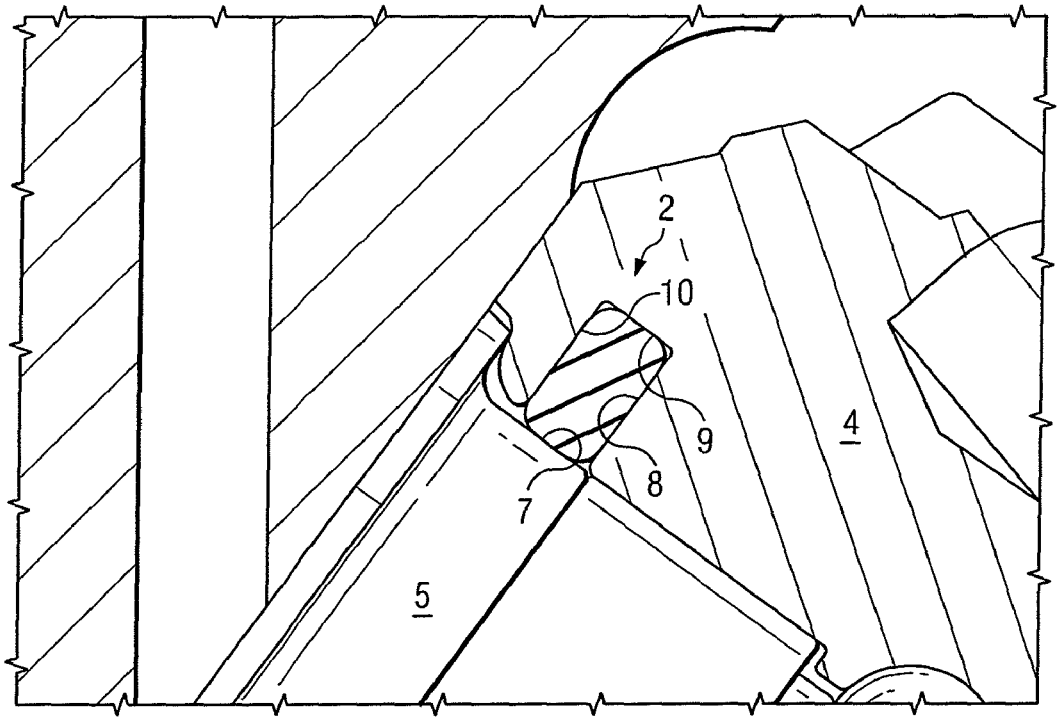
FIG. 3 (PRIOR ART)
FIG. 3 illustrates another prior art seal configuration.

Reference is now made to FIG. 3 wherein there is shown another prior art seal. In this case the seal is a high aspect ratio seal. It will be noted that the seal 6 is squeezed between the cylindrical cone sealing surface 9 and the cylindrical head sealing surface 7. An inner radial (normal) cone surface 8 is provided on the grease side of the seal, while an outer radial (normal) cone surface 10 is provided on the drilling fluid side of the seal. The normal surfaces 8 and 10 are required to stabilize the seal (for example, prevent motion, buckling, twisting) when in operation. It will also be noted that surface 10 is located on the cone 4 (not the head as in FIG. 2).

Figure 4:
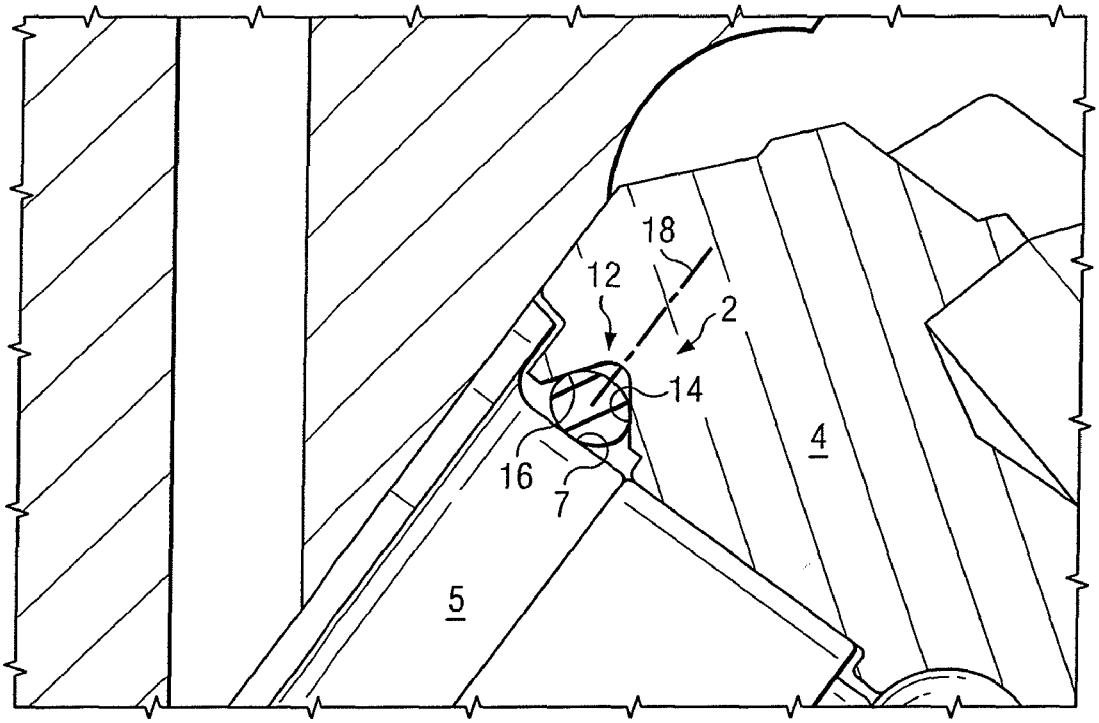
FIG. 4 (PRIOR ART)
FIG. 4 illustrates another prior art seal configuration.

Reference is now made to FIG. 4 wherein there is shown another prior art seal. In this case the sealing system 2 includes a gland (associated with the cone 4) with a V-ramp geometry 12. The V-ramp is defined by an inner (radial, but not normal) surface 14 on the grease side of the seal (to the right of the line of symmetry 18), and an outer (radial but not normal) surface 16 on the drilling fluid side of the seal (to the left of the line of symmetry 18). These radial surfaces 14 and 16 are symmetrically opposed to each other (i.e., mirror images of each other) about the line of symmetry 18. The o-ring seal 6 is squeezed between the cone sealing surfaces 14 and 16 and the head sealing surface 7. More specifically, it will be noted that each of surfaces 7, 14 and 16 are functioning as sealing surfaces.

Figure 5:
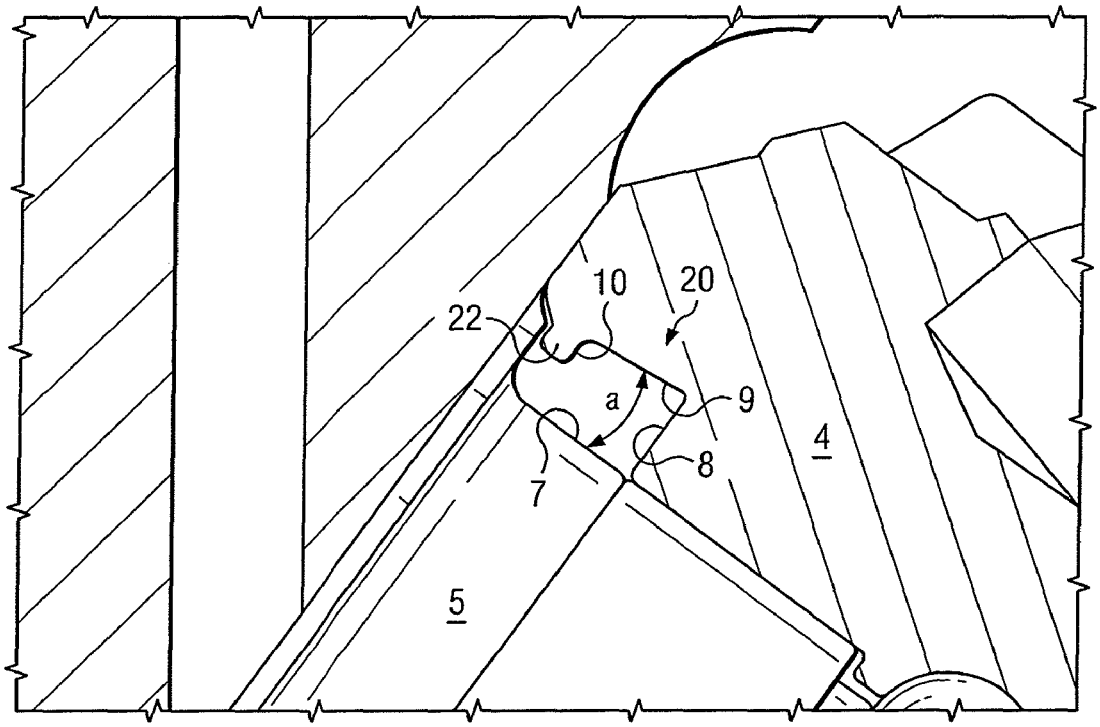
FIG. 5 illustrates an embodiment of a seal gland.

Reference is now made to FIG. 5 which illustrates an embodiment of a seal gland 20. The actual o-ring seal 6 is not shown in FIG. 5 in order ensure that features of the geometry and configuration used in the seal gland 20 area are not obscured. It will be understood by those skilled in the art how the seal 6 would fit within the gland 20, and this is further illustrated in FIG. 6. It will further be understood that the o-ring type of seal is an exemplary seal and that seals having cross-sections other than circular may be used if desired.

The preferred arrangement has the o-ring seal 6 located between the bearing shaft 5 and the cone 4. The seal gland 20 is composed of at least one non-cylindrical (more specifically, conical) cone sealing surface 9 forming an angle a with its opposing cylindrical shaft sealing surface 7 and extending inwardly of and from a distal end of the radial cone surface 8 (i.e., the end located furthest away from the axis of rotation) such that the cone sealing surface 9 is positioned inside an imaginary cylindrical surface extending perpendicular from the distal end of the radial cone surface 8. Again, the term "cylindrical" refers to a surface which is parallel to the bearing axis for cone rotation, while the term "non-cylindrical" refers to a surface which is not perpendicular to the axis of rotation, for example, forming a conical surface. The seal 6 is confined axially between an inner radial cone surface 8 (on the grease side) and an outer radial cone surface 10 (on the drilling fluid side). Again, the term "radial" refers to a surface extending either towards or away from the bearing axis. In this implementation, both of surfaces 8 and 10 are normal surfaces with respect to the axis of rotation. The outer radial cone surface 10 is formed by an inwardly radially extending projection 22 (defining a surface projecting inwardly from the conical cone sealing surface 9 towards, and in this specific case normal to, the bearing axis).

Figure 6:
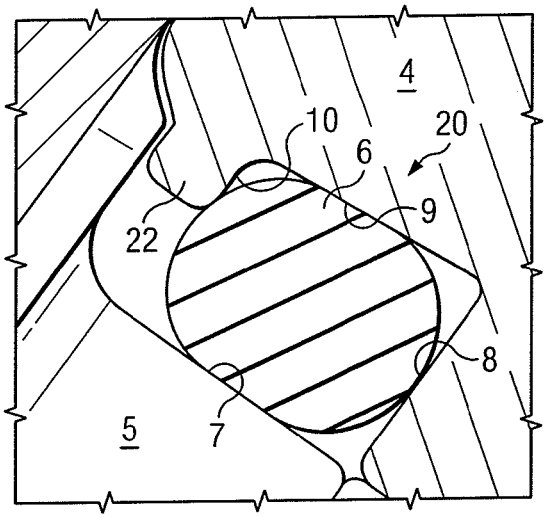
FIG. 6 illustrates a close-up view of the seal gland of FIG. 5 within an installed seal.

FIG. 6 illustrates a closer view of the seal in the embodiment of FIG. 5 and further illustrates the positioning of the o-ring seal 6 within the gland area. The bias provided by the outer radial cone surface 10 as well as the conical cone sealing surface 9 pushes the o-ring seal 6 toward the inner radial cone surface 8. This is beneficial as it helps to retain the seal in a preferred dynamic sealing zone. The effect of the angle a between surfaces 9 and 7 is to effectuate an axial squeeze of the o-ring seal, and it will be noted that the angle a causes portions of surface 9 to have a smaller separation from cylindrical shaft sealing surface 7 near the exterior drilling fluid side of the seal than near the interior grease side of the seal. The angle a defined between the surfaces 7 and 9 bias the o-ring seal in a position towards the inner radial cone surface 8 which can form a stopping surface to retain the seal in a preferred dynamic sealing zone. In a preferred implementation, the angle a is about 4 degrees. The angle a may take on any value, for example, between about 2 and 10 degrees, or any value which provides a sufficient amount of bias towards the inner radial cone surface 8 (and perhaps up to 20 degrees). It will be noted that surface 8 is not necessarily a sealing surface.

A number of alternative embodiments are possible. These include, but are not limited to: a non-cylindrical (conical) surface on the bearing shaft; combining the outer retaining surface 10 with the non-cylindrical (conical) sealing surface 9; and allowing both sealing surfaces 7 and 9 to be non-cylindrical (conical).

Figure 7A:
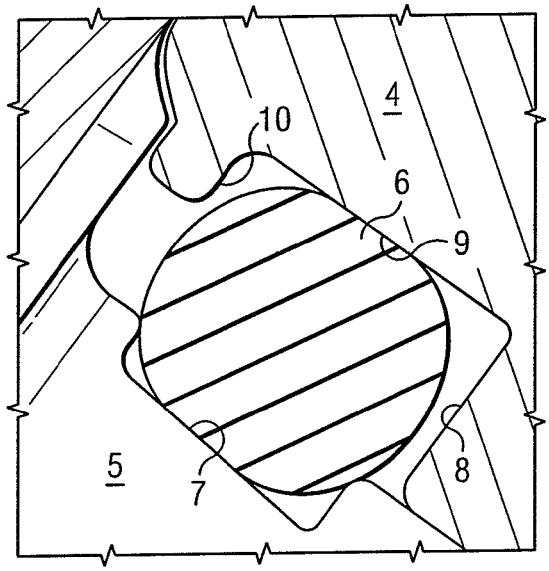
FIGS. 7A-7F illustrate a number of alternative configurations for providing conical sealing surfaces.
Figure 7B:
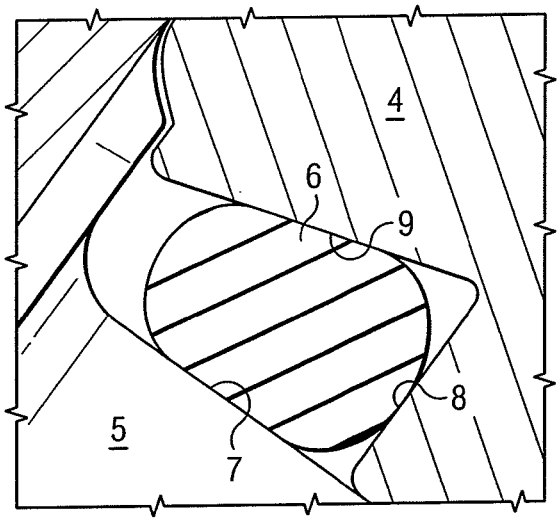
Figure 7C:
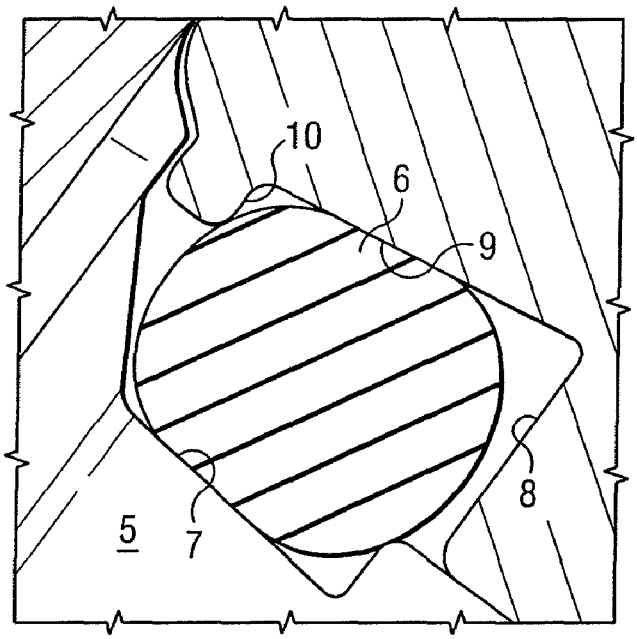
Figure 7D:
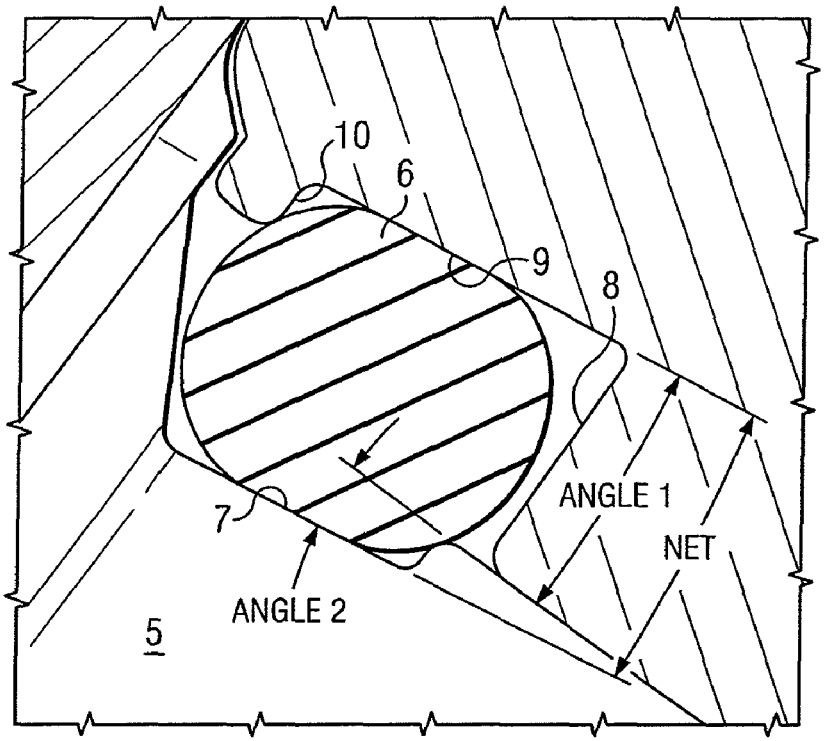
Figure 7E:
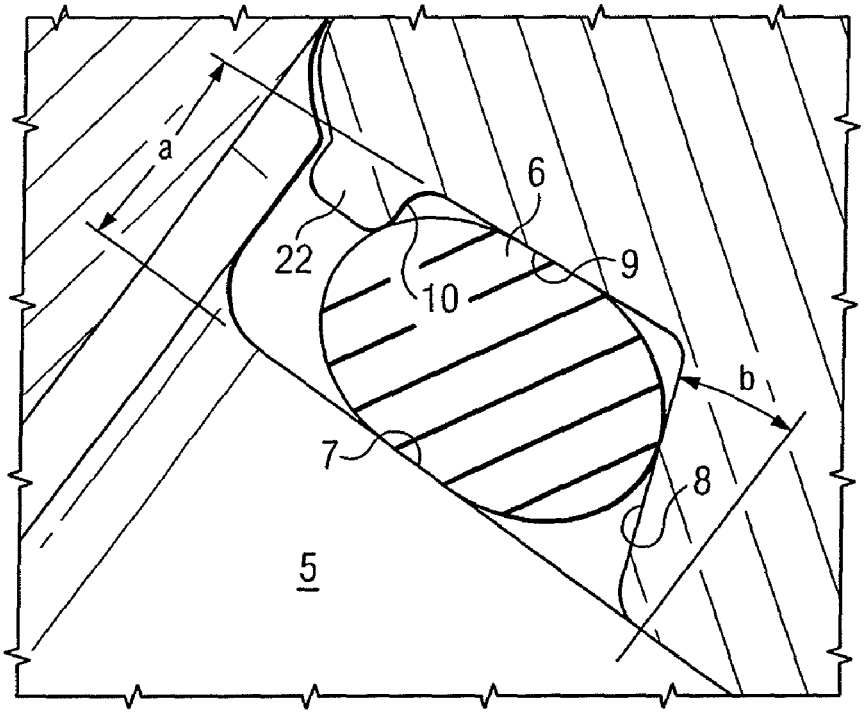
Figure 7F:
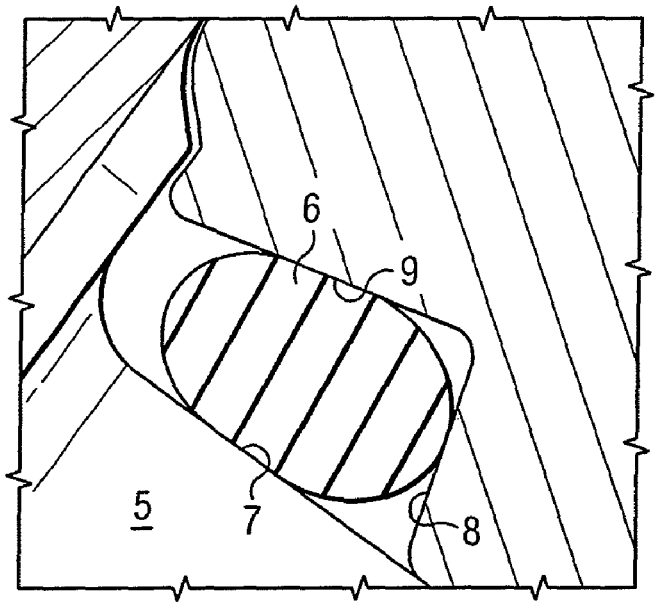

Reference is made to FIGS. 7A and 7F which illustrate a number of alternative configurations for providing conical sealing surfaces.

FIG. 7A shows that the non-cylindrical surface can alternatively be placed on the head side of the seal. Thus, it is shaft sealing surface 7 which is conical (i.e., non-cylindrical with respect to the bearing axis), while cone sealing surface 9 is cylindrical. The angle a in this case is defined with respect to the shaft sealing surface 7 and can take on any of the same values and ranges described above for angle a in FIG. 6. FIG. 7A further shows that a radial and normal surface on the head which is diagonally opposite surface 10 is used to stop the movement of the seal and hold the seal in the dynamic sealing zone.

FIG. 7B shows the use of a non-cylindrical (conical) cone sealing surface 9 without making use of a projection (references 10 and 22 of FIGS. 5 and 6). In this implementation, the angle a formed between the cone sealing surface 9 and the shaft sealing surface 7 may, for example, be approximately 30°, and have a possible range of values between 20-40 degrees. The increased values for angle a obviate the need in this implementation for the projection 22 and surface 10, but it will be understood that an inwardly and radially extending surface 10 could be included in the FIG. 7B implementation if desired.

FIGS. 7C and 7D both show non-cylindrical surfaces being used for both of surfaces 7 and 9. In FIG. 7C, the surfaces 7 and 9 are both conical, but have opposite orientations (with cone sealing surface 9 angling away from the axis of cone rotation in the grease side direction, and shaft sealing surface 7 angling towards the axis of cone rotation in the grease side direction). The angles formed by the surfaces 7 and 9 with respect to the axis of cone rotation need not be the same, but should nonetheless be set so as to ensure biasing of the seal 6 towards the inner cone surface 8. In FIG. 7D, the surfaces 7 and 9 are again both conical, but have similar (or common) orientations (with cone sealing surface 9 angling away from the axis of cone rotation in the grease side direction, and shaft sealing surface 7 angling towards the axis of cone rotation in the mud side direction). It will be noted that in FIG. 7D the angle 1 and angle 2 are not equal thus producing a net angle which compresses the seal and biases the seal towards the inner cone surface 8. Again, a radial and normal surface on the head which is diagonally opposite surface 10 is used in FIGS. 7C and 7D to stop the movement of the seal and hold the seal in the dynamic sealing zone.

FIGS. 7E and 7F show the use of a non-cylindrical (conical) cone sealing surface 9, but further show that inner cone surface 8 is radial, but is not normal to the bearing axis (for example, forming a conical surface sloping towards the seal) to assist with the desired biasing of the seal 6 in a non-symmetrical conical surface configuration. The surface 8 is not a sealing surface as the seal is provided at surfaces 7 and 9. The angle b of inner radial cone surface 8 as measured from normal (i.e., from perpendicular to the bearing axis for cone rotation) need not be substantial in order to achieve biasing benefits. For example, the angle b may range from a few (for example, 2-4) degrees to about 25 degrees. More particularly, an angle b of about 10-15 degrees may be preferred. Angles of between about 5 and 10 degrees for angle b also may be preferred. The angle a can continue to have values in the ranges as discussed above (for example, about 2-40 degrees). With respect to FIG. 7F, this embodiment, like that shown in FIG. 7B, eliminates the structure 22 and surface 10. Angles for conical cone sealing surface 9 in this implementation continue to have values in the ranges as discussed above.

Reference is once again made to FIGS. 7A, 7C and 7D. As discussed above, a radial and normal surface is positioned on the head diagonally opposite surface 10. This surface is used to stop the movement of the seal and hold the seal in the dynamic sealing zone, and serves the same function as surface 8 in, for example, FIGS. 6, 7B, 7E, 7F, 8 and 9. What will be recognized is that the surface functioning to stop the movement of the seal and hold the seal in the dynamic sealing zone is a surface which is on the same component part of the bit (either head or cone) which contains the major (or dominant) conical surface. In the embodiments with only one conical surface, the surface functioning to stop the movement of the seal and hold the seal in the dynamic sealing zone is on the part where that conical surface is located. FIGS. 7C and 7D have two conical surfaces associated with sealing. The selected location of the surface functioning to stop the movement of the seal and hold the seal in the dynamic sealing zone corresponds to the part where the conical sealing surface having the highest conical half-angle is located (because it is this surface which has the most effect on seal squeeze).

Figure 8:
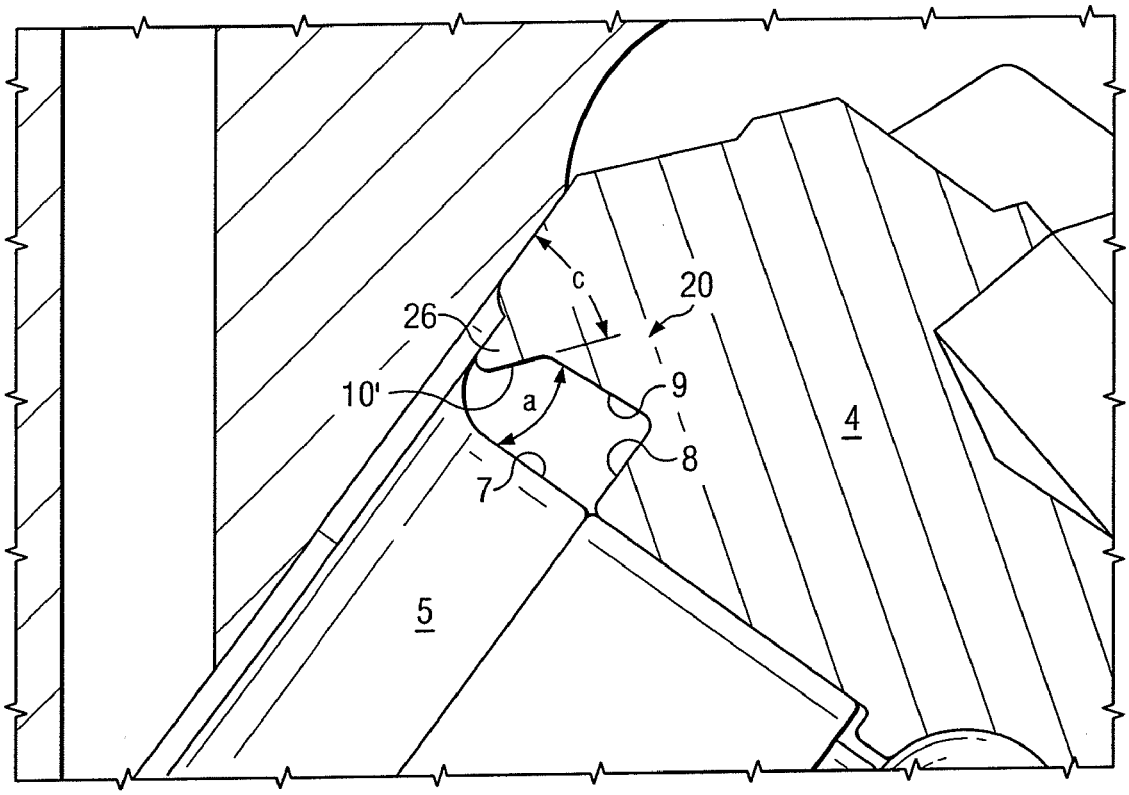
FIGS. 8 and 9 illustrate another embodiment.
Figure 9:
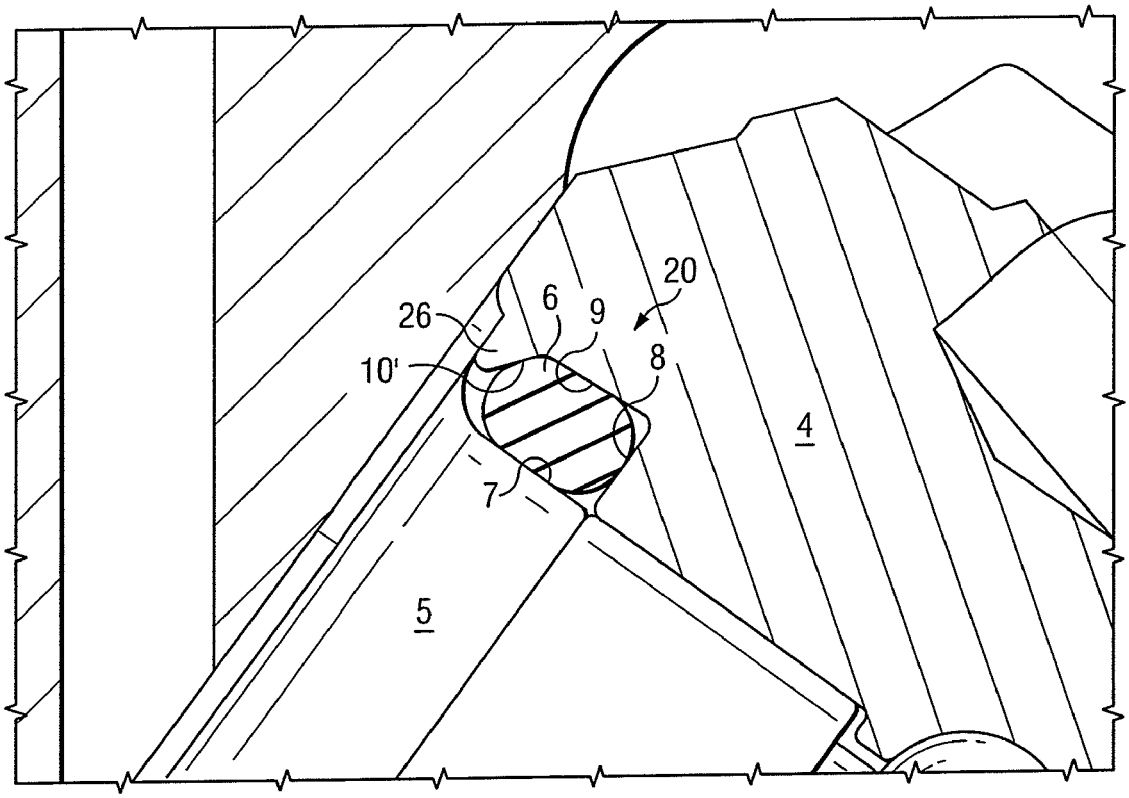

Reference is now made to FIGS. 8 and 9 wherein there is shown another embodiment. The cone sealing surface 9 is again a non-cylindrical (conical) surface and has an associated angle a having values in the ranges as discussed above (for example, about 2-40 degrees). FIG. 8 also shows the use of a different shaped projection 26 for surface 10 which defines a sloped (radial but not normal) surface 10' extending further inwardly from conical cone sealing surface 9. The sloped surface 10' of the projection 26 extending from conical cone sealing surface 9 forms an angle c with respect to normal (perpendicular to axis of rotation). This angle c may be approximately 45 degrees and may have a range of values from 30-50 degrees. Thus, there are two non-cylindrical surfaces 9 and 10' present in this embodiment which assist in effectuating the desired biasing of the seal towards surface 8.

The arrangement in FIGS. 8 and 9 has the seal 6 located between the bearing shaft and the cone. The seal gland is composed of an inner radial cone surface 8 (grease side) and at least one slanted surface comprising conical cone sealing surface 9 and perhaps additionally sloped surface 10'. The axial squeeze component is introduced by having a non-parallel relationship between the shaft sealing surface 7 and the conical cone sealing surface 9. The seal is squeezed between axial shaft sealing surface 7 and the conical cone sealing surface 9, with the sloped surface 10' and the inner radial cone surface 8 retaining the seal in the preferred dynamic sealing zone. Because of the bias provided by surfaces 9 and 10', the seal is pushed towards inner radial cone surface 8, but surface 8 does not function as a sealing surface.

Although preferred embodiments of the method and apparatus have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A sealing system for a drill bit including a bit head and a rotating bit cone, comprising:

a seal gland defined by a conical cone non-sealing surface and further defined by a cylindrical head sealing surface and an opposed conical cone sealing surface;

a seal radially compressed by and between the cylindrical head sealing surface and the opposed conical cone sealing surface;

wherein the conical cone sealing surface extends radially inwardly from the conical cone non-sealing surface and wherein angles formed by the conical cone non-sealing surface and conical cone sealing surface with respect to a direction normal to cone axis of rotation are not symmetric.

2. The sealing system of claim 1 further comprising a radially projecting feature extending inwardly from the conical cone sealing surface.

3. The sealing system of claim 2 wherein the radially projecting feature comprises an inwardly extending normal surface.

4. The sealing system of claim 2 wherein the radially projecting feature assists in biasing the radially compressed seal against the conical cone non-sealing surface.

5. The sealing system of claim 2 wherein the radially projecting feature assists in biasing the radially compressed seal towards the conical cone non-sealing surface.

6. The sealing system of claim 1 wherein an angle defined between the conical cone non-sealing surface and a direction normal to cone axis of rotation is between 2 and 25 degrees.

7. The sealing system of claim 1 wherein an angle defined between the conical cone sealing surface and the opposed cylindrical head sealing surface is about between 2 and 40 degrees.

8. A sealing system for a drill bit including a bit head and a rotating bit cone, comprising:

a seal gland defined by a first conical surface on the cone which extends with an orientation that is non-perpendicular to an axis of cone rotation, a cylindrical head surface and an opposed second conical surface on the cone coupled to an end of the first conical surface;

a seal radially compressed by and between the cylindrical head surface and the opposed second conical surface;

wherein the second conical surface extends radially inwardly from the end of the first conical surface and wherein a first angle formed between the first conical surface and perpendicular to the axis of cone rotation is different than a second angle formed between the second conical surface and perpendicular to the axis of cone rotation.

9. The sealing system of claim 8 further comprising a radially projecting feature extending inwardly from the second conical surface.

10. The sealing system of claim 9 wherein the radially projecting feature comprises an inwardly extending surface perpendicular to the axis of cone rotation.

11. The sealing system of claim 9 wherein the radially projecting feature assists in biasing the radially compressed seal against the first conical surface.

12. The sealing system of claim 9 wherein the radially projecting feature assists in biasing the radially compressed seal towards the first conical surface.

13. The sealing system of claim 8 wherein the first angle is about between 2 and 25 degrees.

14. The sealing system of claim 8 wherein an angle between the second conical surface and the cylindrical head surface is about between 2 and 40 degrees.

15. A sealing system for a drill bit including a bit head and a rotating bit cone, comprising:

a seal gland defined by a first conical surface in the cone, a cylindrical sealing surface in the head and an opposed second conical surface in the cone, wherein the first conical surface extends from a first end adjacent the cylindrical sealing surface to a second end, and the second conical surface extends radially inwardly from a first end coupled to the second end of the first conical surface to a second end;

a seal radially compressed by and between the cylindrical sealing surface and the opposed second conical surface;

wherein angles formed by the first conical surface and the second conical surface with respect to a direction normal to cone axis of rotation are not symmetric.

16. The sealing system of claim 15 further comprising a radially projecting feature extending inwardly from the second conical surface.

17. The sealing system of claim 16 wherein the radially projecting feature comprises an inwardly extending surface perpendicular to the axis of cone rotation.

18. The sealing system of claim 16 wherein the radially projecting feature assists in biasing the radially compressed seal against the first conical surface.

19. The sealing system of claim 16 wherein the radially projecting feature assists in biasing the radially compressed seal towards the first conical surface.

20. The sealing system of claim 15 wherein the first angle is about between 2 and 25 degrees.

21. The sealing system of claim 15 wherein an angle between the radially second conical surface and the cylindrical sealing surface is about between 2 and 40 degrees.

* * * * *